US005365611A

United States Patent [19]

Chiles et al.

[11] Patent Number: 5,365,611

[45] Date of Patent: Nov. 22, 1994

[54] APPARATUS FOR PROTECTING AN OBJECT FROM INCLEMENT WEATHER

[75] Inventors: Mary E. Chiles, 1527 Sutter; Cathy E. Caldwell, 3215 Nebraska Ave., both of Dallas, Tex. 75216

[73] Assignees: Mary E. Chiles; Cathy E. Caldwell, Dallas, Tex.

[21] Appl. No.: 989,068

[22] Filed: Dec. 11, 1992

[51] Int. Cl.[5] ..... A41D 13/08

[52] U.S. Cl. ..... 2/16

[58] Field of Search ..... 2/16, 17, 66, DIG. 5, 2/170; 224/219, 220, 221; 383/41, 67

[56] References Cited

U.S. PATENT DOCUMENTS

| | | | |
|---|---|---|---|
| 214,796 | 4/1879 | Thompson | 2/16 |
| 3,321,091 | 6/1943 | Kertesz et al. | 2/159 |
| 2,337,767 | 12/1943 | Paul | 2/17 |
| 2,590,462 | 3/1952 | Rassenfoss | 383/67 X |
| 3,079,610 | 3/1963 | Guerra | 2/16 |
| 3,570,009 | 3/1971 | Spruell | 2/16 |
| 4,214,317 | 7/1980 | Kelly, Sr. | 2/2 |
| 4,578,823 | 4/1986 | Hudson, Jr. | 2/16 |
| 4,893,372 | 1/1990 | Wenzel | 2/16 X |
| 5,172,427 | 12/1992 | Van Bergen et al. | 2/158 |

*Primary Examiner*—Clifford D. Crowder
*Assistant Examiner*—Paul C. Lewis
*Attorney, Agent, or Firm*—Vinson & Elkins

[57] ABSTRACT

The present invention includes an apparatus for use by a person for protecting an object from inclement weather. The apparatus includes a first and second panel member, both of which have an edge. The edges of the first and second panel members are attached to one another, thereby defining an interface along the attachment and defining an interior area between the members as well. In addition, an aperture is formed along the interface such that a person's hand may be inserted through the aperture and into the interior area.

Additional detail may be included with the apparatus of the present invention. For example, an end panel member may be attached at one end of the apparatus and between the first and second panel members. In addition, a resilient member such as a cuff may be attached along the aperture. Finally, various band members may be attached along interfaces and edges of the apparatus to add both strength and appearance to the apparatus.

6 Claims, 2 Drawing Sheets

APPARATUS FOR PROTECTING AN OBJECT FROM INCLEMENT WEATHER

TECHNICAL FIELD OF THE INVENTION

This invention relates in general to protective devices, and more particularly to an apparatus for use by a person for protecting an object from inclement weather.

BACKGROUND OF THE INVENTION

Various outdoor activities involve the use of relatively small objects which may be manipulated by a person's hands. In many instances, the user may anticipate handling the object in dry weather. For example, the everyday activities of a typical mail carrier involve walking from mailbox to mailbox and placing one or more paper mail items in each mailbox. More often than not, this activity occurs during dry weather. If it begins to rain, the mail carrier is posed with the problem of having to maintain the mail in a dry condition. Currently, there is no known specific type of protective apparatus available for handling mail in wet weather. As a result, the mail may get wet and the moisture may cause the address or print on the mail to become illegible. Moreover, the internal contents of the mail may get wet as well.

Inclement weather (e.g., rain and/or snow) has heretofore caused mail carriers to use make-shift techniques in an attempt to protect the mail. For example, many mail carriers attempt to shield the mail from the weather by holding it within their coats. As an alternative, many carriers simply wait until the troublesome weather ceases before completing their routes. Naturally, this latter technique slows the process and may cause the mail to be delayed. In addition, a burden is imposed on the mail carrier and the entire postal system.

It is therefore an object of the present invention to provide an apparatus for use by a person, such as a mail carrier, for protecting an object from inclement weather.

It is yet another object of the present invention to provide a protective apparatus of a sufficient size to accommodate a particular object sought to be protected from the inclement weather.

It is yet another object of the present invention to provide an protective apparatus made of a transparent material so that the person may view the objects protected by the apparatus.

It is still another object of the present invention to provide an apparatus having a resilient member, such as a cuff, so that a person may slip his or her hand into the apparatus and hold the object within the apparatus.

Still other objects and advantages of the present invention will be readily apparent to those having skill in the art having reference to the following specification, together with its drawings.

SUMMARY OF THE INVENTION

In accordance with the present invention, an apparatus for use by a person for protecting an object from inclement weather is provided which substantially reduces the disadvantages and problems associated with having to protect objects from inclement weather, and seeks to further the objects set forth above.

The present invention includes an apparatus for use by a person for protecting an object from inclement weather. The apparatus includes a first and second panel member, both of which have an edge. The edges of the first and second panel members are attached to one another, thereby defining an interface along the attachment and defining an interior area between the members as well. In addition, an aperture is formed along the interface such that a person's hand may be inserted through the aperture and into the interior area.

BRIEF DESCRIPTION OF THE DRAWINGS

For a more complete understanding of the present invention, and the advantages thereof, reference is now made to the following description taken in conjunction with the accompanying drawings, in which.

DETAILED DESCRIPTION OF THE INVENTION

The preferred embodiment of the present invention and its advantages are best understood by referring to FIGS. 1–4*g* of the drawings, like numerals being used for like and corresponding parts of the various drawings.

Figure 1:
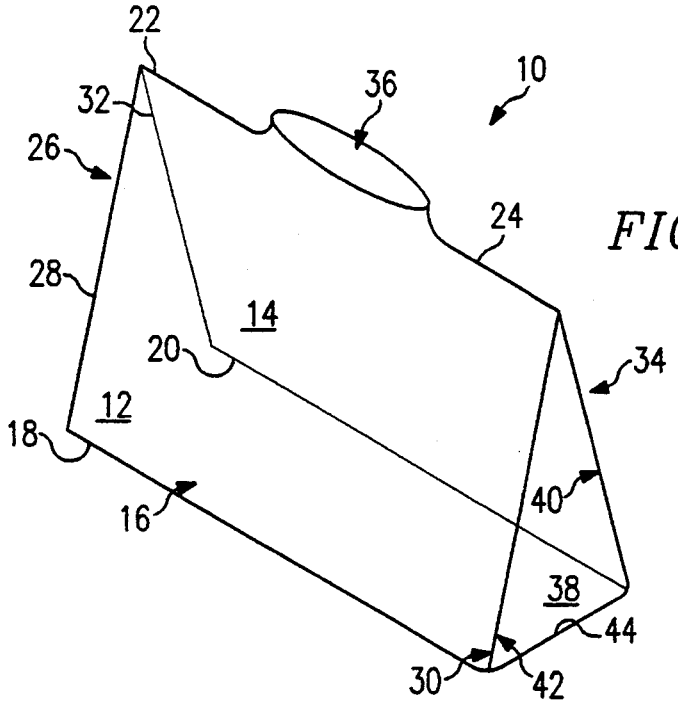
FIG. 1 illustrates a first embodiment of the present invention having three panels and an aperture formed along the interface of two of the panels.

FIG. 1 illustrates an apparatus designated generally at 10 and for use by a person for protecting an object from inclement weather. Apparatus 10 includes a first panel 12 and a second panel 14. In the preferred embodiment, panels 12 and 14 are constructed of a light-weight and somewhat flexible material. For example, panels 12 and 14 may be constructed of twelve gauge vinyl. Panels 12 and 14 are also preferably of the same shape, such as rectangular. Thus, panel 12 has a top and bottom longitudinal edge 16 and 18, respectively. Similarly, panel 14 has a top and bottom longitudinal edge 20 and 22, respectively. Preferably, longitudinal edges 16, 18, 20 and 22 are on the order of 14.0 inches in length. Panels 12 and 14 are joined along top edges 16 and 18, thereby creating an interface designated generally at 24. An interior area 26 is defined below interface 24 and between panels 12 and 14. In addition, it is preferable that the vinyl material of panels 12 and 14 is relatively or absolutely transparent so that an operator of apparatus 10 may view items within interior area 26. Panel 12 also includes side edges 28 and 30. Likewise, panel 12 includes side edges 32 and 34. Side edges 28, 30, 32 and 34 are on the order of ten inches in length.

An aperture 36 is formed along interface 24. Aperture 36 is sized so that a person's hand may be placed through aperture 36 and into interior area 26. Thus, in the preferred embodiment, aperture 36 is on the order of seven inches in length. As discussed in greater detail below, a resilient member may be disposed around the perimeter of aperture 36 for providing a seal and retention between the operator's wrist or arm and the remainder of apparatus 10.

In the preferred embodiment, an end panel 38 is also included within apparatus 10. End panel 38 is shaped and sized so that it may be affixed to edges 30 and 34 of panels 12 and 14, respectively. Thus, given the dimensions discussed above, end panel 38 is preferably triangular in shape and its side edges 40 and 42 are approximately 9.0 inches in length. Further, end panel 38 has a bottom edge 44 which is sized to allow panels 12 and 14 to move a limited distance from one another. In the preferred embodiment, this distance of bottom edge 44 is 7.0 inches in length.

Note that end panel 38 could be replaced with a different structure, such as a rod or the like, attached between edges 30 and 34 of panels 12 and 14, respectively. End panel 38 is preferred, however, because it creates a three-sided structure for apparatus 10 which, as described below, assists in protecting an object from inclement weather. Further, while end panel 38 is preferred, it could be eliminated thereby leaving apparatus 10 open at both ends. As yet another alternative, a second end panel (not shown) could be attached to edges 28 and 32 of panels 12 and 14, respectively, thereby causing apparatus 10 to have four sides rather than three.

Figure 2:
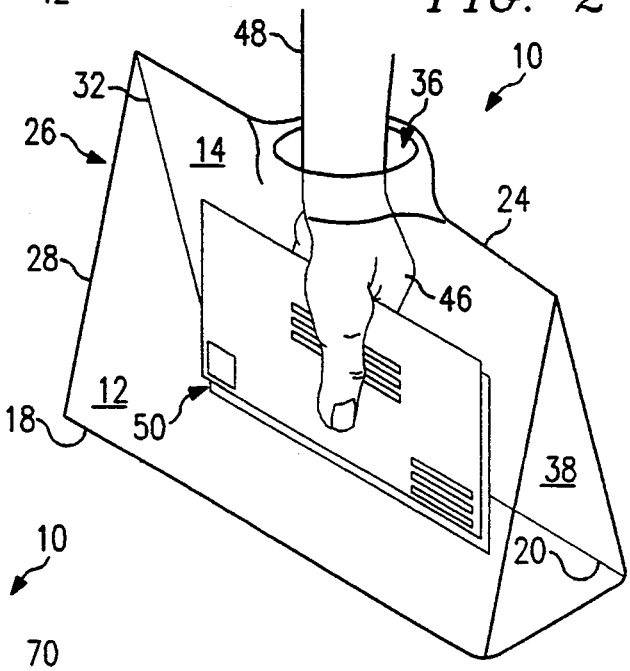
FIG. 2 illustrates an exemplary use of the preferred embodiment shown in FIG. 1.

FIG. 2 illustrates the preferable use for apparatus 10. Specifically, apparatus 10 has particular advantages when used by a mail carrier. For purposes of ease of illustration, only certain reference numerals from FIG. 1 are carried forward into FIG. 2. In FIG. 2, a left hand 46 is shown disposed within interior area 26 of apparatus 10. As shown, a person may insert his or her hand through aperture 36 formed along interface 24. As stated above, although not shown in FIG. 2, a resilient member may be formed along aperture 36 so that a seal is accomplished between aperture 36 and the arm 48 of the person. As a result, any falling moisture, such as rain or snow, is effectively sealed out of interior area 26. In addition, the resilient member maintains apparatus 10 in a fixed relationship to the person's hand 46. Thus, apparatus 10 will not slide up and down on the person's arm 48 and, hence, will not interfere with their ability to clutch an object within interior area 26.

For purposes of illustration, hand 46 is shown clutching several pieces of mail, designated generally at 50. Thus, a mail carrier may hold one or more pieces of mail 50 within interior 26, thereby preventing mail 50 from coming in contact with inclement weather. Moreover, because panel members 12 and 14 are preferably transparent, the person holding mail 50 may readily read the address information through apparatus 10. When delivering mail, the mail carrier may use his or her free hand to grab a handful of mail within apparatus 10. Specifically, when approaching a mailbox, the carrier views the desirable addresses through the vinyl material of panels 12 and 14, selects the appropriate items, and places them in the correct mailbox. To remove mail, the mail carrier may turn apparatus 10 so that end panel 38 faces upward. In this manner, the mail carrier has easy access to mail 50 by reaching in the bottom of apparatus 10 along edges 18 and 20. Further, because apparatus 10 is preferably open along edges 28 and 32, the mail carrier may also use his or her free hand to reach through the open side into interior area 26, and remove those pieces of mail which need to be delivered to the appropriate address. This side-access prevents the person from having to turn apparatus 10 over which might expose mail 50 to the troubling weather conditions. As mentioned above, end panel 38 could be removed, thereby providing access to mail 50 from either the end illustrated as open in FIG. 2, or the end illustrated as including end panel 38 in FIG. 2, as well.

From the above, it should appreciated that the present invention provides a mechanism by which an object, such as mail, may be temporarily protected from inclement weather. While apparatus 10 has been described in connection with the manipulation of mail, note that apparatus 10 may be used in other instances as well. For example, for persons attending sporting events, it is not uncommon for inclement weather to occur during the event. In this instance, the spectator may wish to prevent various objects from being exposed to the inclement weather. For example, the typical spectator at a sporting event may have purchased some type of beverage or food item. Apparatus 10 could be used to temporarily shield the beverage or food item from falling rain or snow. Still other examples of use of the present invention should be readily apparent to persons having skill in the art, and are in no way intended to be beyond the scope of this invention.

Figure 3:
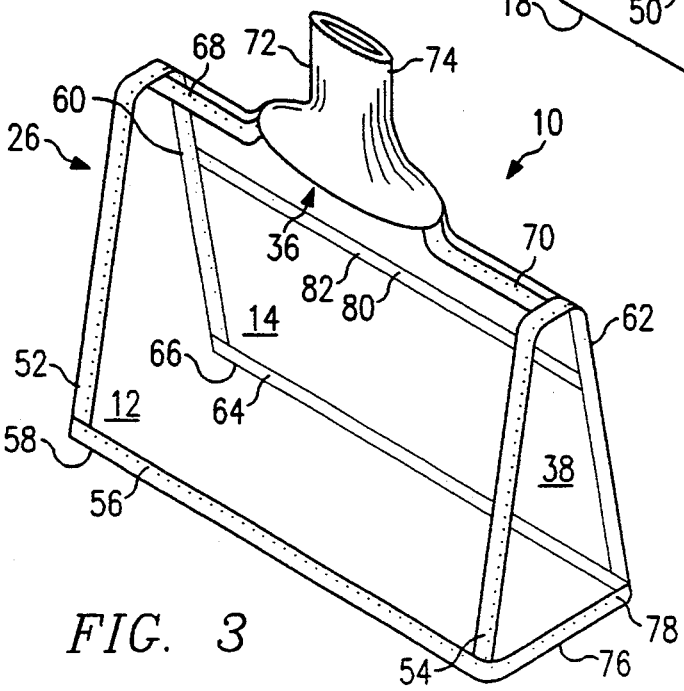
FIG. 3 illustrates the preferred embodiment of the present invention.

FIG. 3 illustrates the preferred embodiment of the present invention. Specifically, FIG. 3 illustrates a detailed version of apparatus 10 including various additional features. Again, apparatus 10 includes two rectangular panels 12 and 14, as well as an end panel 38. In general, the edges of panels 12, 14 and 38 are not visible in FIG. 3 as they are protected by various bands. Specifically, two side bands 52 and 54 are attached to panel 12. In the preferred embodiment, side bands 52 and 54, as well as the additional bands described herein, are sewn to the respective vinyl material as described in greater detail below. As such, these bands add strength, as well aesthetic appearance to apparatus 10. Panel 12 also includes a malleable member 56, preferably a bendable piece of 14-gauge solid wire, along its bottom edge. Malleable member 56 is enclosed and encased along the edge by a longitudinal band 58 and, therefore, is shown as a dotted line. Malleable member 56, as well as other malleable members discussed below, add support and some physical flexibility to apparatus 10. It should be noted that the support function could be accomplished by using an alternative non-flexible material such as a dowel rod. Panel 14 also has side bands 60 and 62 attached along its edges. In addition, a malleable member 64 is secured along the bottom edge of panel 14 by a longitudinal band 66.

In FIG. 3, interface 24 (illustrated in FIG. 2) is covered and secured by a left interface band 68 and a right interface band 70. Bands 68 and 70 terminate at aperture 26. Moreover, in the preferred embodiment of FIG. 3, a cuff 72 is secured along aperture 36. Cuff 72 is constructed in the same manner as is a common cuff on a glove such as a glove typically used for gardening purposes. In the preferred embodiment, cuff 72 is knitted yarn being 50% synthetic and 50% cotton. As a result, the upper edge 74 of cuff 72 is somewhat elastic. Thus, in a sense, apparatus 10 is worn in the same manner as is a glove. Cuff 72 provides a mild seal when a person's hand is inserted through it in the same manner illustrated in FIG. 2 above. This seal prohibits inclement weather, such as rain or snow, from entering through aperture 36 and reaching interior area 26. In addition, cuff 74 operates to mildly retain apparatus 10 in a fixed position relative to the hand of the operator. Thus, cuff 72 holds apparatus 10 in place so that it does not shift upward or downward along the arm and/or wrist of the person using apparatus 10.

With reference to end panel 38, a band 76 is attached along its bottom edge, thereby extending between bands 56 and 64 attached to panels 12 and 14, respectively. In addition, a malleable member 78 (shown by dotted line)

of the same type as members 56 and 64 is maintained by band 76 along the bottom edge of end panel 38.

In the preferred embodiment, panel 14 further includes a malleable member 80 (shown by dotted line) disposed approximately 8.0 inches upward from band 66. A retaining band 82 is attached to panel member 14 for holding malleable member 80 in place. Malleable member 80 provides additional rigidity and structure to apparatus 10.

FIGS. 4*a–g* illustrate the instructional method which is preferably used to assemble the present invention. Again, for ease of illustration, reference numerals corresponding to FIGS. 1–3 are carried through to FIGS. 4*a–g*, where appropriate.

Figure 4A:
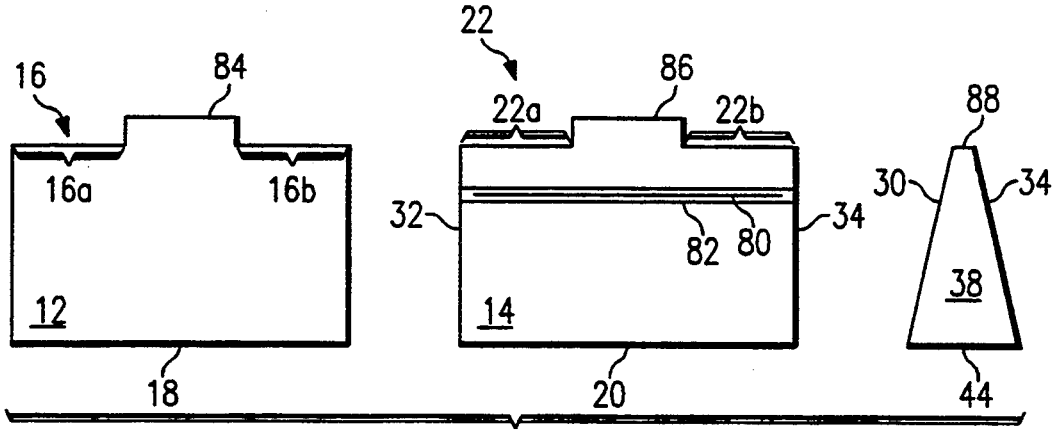
FIGS. 4*a–g* illustrate various instructional steps for constructing the embodiment of FIG. 3.

FIG. 4*a* illustrates the three panels 12, 14 and 38, used to construct apparatus 10 of FIG. 3. With reference to panels 12 and 14, it may be appreciated that these panels are generally rectangular in shape. However, in order to accommodate cuff 74, longitudinal edges 16 and 22 are broken down such that upward tabs 84 and 86 are formed along edges 16 and 22, respectively. In the preferred embodiment, each of tabs 84 and 86 is 7.0 inches in length and 1.0 one inch in height. Further, tabs 84 and 86 are centered along edges 16 and 22, respectively. Because edges 16 and 22 are 14.0 inches overall in length, and because tabs 84 and 86 are centered, the remaining portions, 16*a*, 16*b*, 22*a* and 22*b*, are each 3.5 inches in length.

With reference to panel 14, malleable member 80 is placed between band member 82 and panel 14, and band member 82 is then sewn to panel 14 roughly 8.0 inches upward from edge 20. Further, malleable member 80 extends along the great majority of the length of the panel 14, but stops 0.5 inches from side edges 32 and 34.

With reference to end panel 38, it may be appreciated that in the preferred embodiment, panel 38 is trapezoidal in shape, rather than purely triangular. In particular, panel member 38 includes a top edge 88 which, in the preferred embodiment, is 2.0 inches in length. Side edges 30 and 34 are preferably 9.0 inches in length while bottom edge 44 is 7.0 inches in length.

Figure 4B:
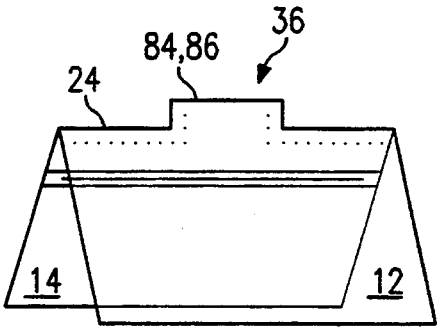
Figure 4C:
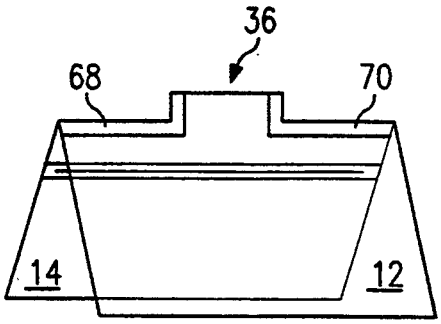

FIGS. 4*b* and 4*c* illustrate the technique for affixing panels 12 and 14 to one another. With reference to FIG. 4*b*, panels 12 and 14 are sewn together along their respective top edges using a ⅜ inch seam allowance. For purposes of illustration, this seam is shown in FIG. 4*b* by consecutive dots. With reference to FIG. 4*c*, left and right interface bands 68 and 70 are sewn over the stitch lines previously sewn in connection with FIG. 4*b*. Note that upward tabs 84 and 86 are not sewn together, thereby creating an aperture 36 between the two tabs.

Figure 4D:
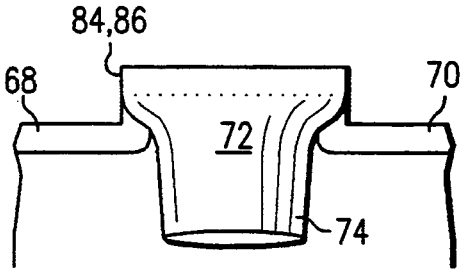
Figure 4E:
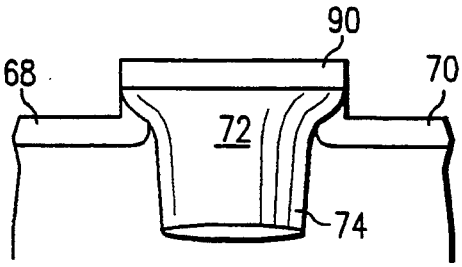

FIGS. 4*d* and 4*e* illustrate the preferred method for attaching cuff 72 to apparatus 10 by showing an enlarged view of cuff 72 attached to tabs 84 and 86. In the preferred embodiment, panels 12 and 14 are turned inside out after attaching bands 68 and 70 as discussed in connection with FIG. 4*c*. Moveover, cuff 72 is likewise turned inside out and sewn along the top edge of tabs of 84 and 86. Again, the seam line is illustrated in FIG. 4*d* by consecutive dots. With reference to FIG. 4*e*, after cuff 72 is sewn to tabs 84 and 86, a collar band 90 is attached along the seam formed in connection with FIG. 4*d*. Collar band 90 is attached over the seam in the same manner as bands 68 and 70. Accordingly, collar band 90 is folded over the seam, and sewn in place. After attaching band 90, panels 12 and 14, and cuff 72, are reversed once again so they are turned right side out.

Figure 4F:
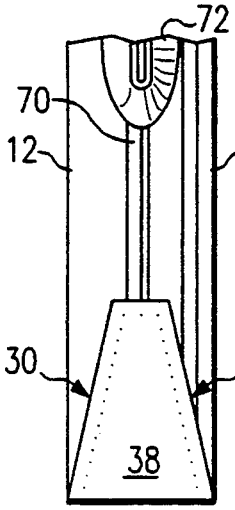
Figure 4G:
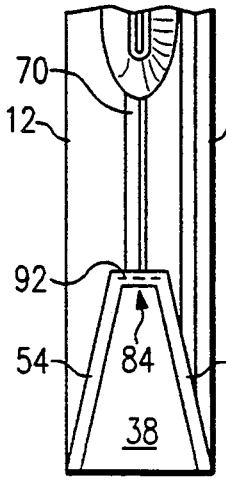

FIGS. 4*f* and 4*g* illustrate an end view facing end panel 38 for illustrating the process for attaching end panel 38 to apparatus 10. With reference to FIG. 4*f*, end panel 38 is aligned along panels 12 and 14. End panel 38 is sewn along its edges to edges 30 and 34 of panels 12 and 14, respectively. In addition, top edge 88 of end panel 38 is aligned along the edge of right interface band 70 and sewn along the consecutive dots illustrated in FIG. 4*f*. FIG. 4*g* illustrates the additional step of affixing side bands 54 and 62 along the seam shown in FIG. 4*f*. Moveover, in the preferred embodiment, before closing the side bands in place, a one inch malleable member 92 (shown by dotted lines) is aligned with top edge 84 of end panel 38. Thereafter, side bands 54 and 62 are permanently affixed in place, and also maintain malleable member 90 as shown. Malleable member 90 provides further support along edge 84 and gives added strength and structure to apparatus 10. Note also that while separate bands are illustrated for side bands 54 and 62, a single band spanning their entire length could be substituted as well. Note also that a similar procedure to that illustrated in FIG. 4*g* is performed to affix side bands 52 and 60 (see FIG. 3) along the opposite side of panel members 12 and 14. As stated above, however, in the preferred embodiment, no second end panel is included and therefore, bands 52 and 60 are merely sewn around outer edges 28 and 32 (see FIG. 1), respectively.

By returning to FIG. 3, the final construction step may be appreciated. Specifically, as a last step, malleable members 56 and 64 are fixed in place via longitudinal bands 58 and 66. Malleable member 56 is placed in the center of band 58, and band 58 is sewn along longitudinal edge 18 (see FIG. 1). Malleable member 56 is preferably situated such that it terminates 0.5 inches from edges 28 and 30 of panel 12. Malleable member 64 is affixed to panel 14 in the same manner. Thus, malleable member 64 is positioned along longitudinal band 66 which thereafter is sewn along bottom edge 20 of panel 14. Malleable member 64 also terminates 0.5 inches from both of edges 32 and 34.

From the above, it may be appreciated that the present invention provides numerous advantages. For example, an apparatus is provided for use by an operator to protect an object from inclement weather. Another advantage is that the apparatus is preferably transparent and, therefore, the operator may view the object while it is disposed within the inventive apparatus. Still another advantage is that the apparatus is relatively lightweight and may be, in effect, worn by the user with very little effort. Still other advantages should be readily apparent to one skilled in the art. In addition, although the present invention has been described in detail, it should be understood that various substitutions, modifications, and alterations could be made to it without departing from the intended scope of the invention as defined by the following claims.

What is claimed is:

1. An apparatus for use by a person and for protecting an object from inclement weather, comprising:

a first rectangular panel member having a longitudinal edge and a side edge;

a second rectangular panel member having a longitudinal edge and a side edge, wherein said longitudinal edge of said second panel member is attached to said longitudinal edge of said first panel member defining an interface along said attachment and defining an interior area between said panel members, wherein said interface includes an aperture along said interface such that a hand of said person may be inserted through said aperture and into said interior area;

a resilient member attached along said aperture such that a hand of said person may be inserted through said resilient member and said aperture into said interior area; and an end panel member having a first and second edge, wherein said first edge of said end panel member is connected to said side edge of said first panel member, and wherein said second edge of said end panel member is connected to said side edge of said second panel member.

2. The apparatus of claim 1 wherein said resilient member comprises a cuff member.

3. The apparatus of claim 1 wherein each of said first and second panel members further has a parallel second longitudinal edge, and wherein said end panel has a third edge opposite said interface, and further comprising:

support members disposed along each of said second longitudinal edges of said first and second panel members; and a support member disposed along said third edge of said end panel member.

4. An apparatus for use by a person and for protecting an object from inclement weather, comprising:

a first panel member and having an edge;

a second panel member having an edge, wherein said edge of said second panel member is attached to said edge of said first panel member defining an interface along said attachment and defining an interior area between said panel members, wherein said interface includes an aperture along said interface such that a hand of said person may be inserted through said aperture and into said interior area; and wherein said edge of said first and second panel members is along the longitudinal length of said rectangular shape, and wherein each of said first and second panel members further has a side edge, and further comprising a third panel member having a first and second edge, wherein said first edge of said third panel member is connected to said side edge of said first panel member, and wherein said second edge of said third panel member is connected to said side edge of said second panel member.

5. The apparatus of claim 4 wherein said third panel has a third edge opposite said interface, and further comprising a malleable member disposed along said third edge.

6. An apparatus for use by a person and for protecting an object from inclement weather, comprising:

a first rectangular panel member having a longitudinal edge;

a second rectangular panel member having a longitudinal edge, wherein said longitudinal edge of said second panel member is attached to said longitudinal edge of said first panel member defining an interface along said attachment and defining an interior area between said panel members, wherein said interface includes an aperture along said interface such that a hand of said person may be inserted through said aperture and into said interior area;

a resilient member attached along said aperture such that a hand of said person may be inserted through said resilient member and said aperture into said interior area;

wherein each of said first and second panels further has a side edge, and further comprising an end panel member having a first and second edge, wherein said first edge of said end panel member is connected to said side edge of said first panel member, and wherein said second edge of said end panel member is connected to said side edge of said second panel member, and wherein said end panel has a third edge opposite said interface, and further comprising a malleable member disposed along said third edge.

* * * * *